US011631296B2

(12) United States Patent
Gallagher et al.

(10) Patent No.: US 11,631,296 B2
(45) Date of Patent: Apr. 18, 2023

(54) GAMING MACHINE CABINET ACCESS STRUCTURE AND METHOD

(71) Applicant: Everi Games, Inc., Austin, TX (US)

(72) Inventors: Craig Steven Gallagher, Austin, TX (US); Daniel C. Gibson, Austin, TX (US); Travis B. Bussey, Austin, TX (US)

(73) Assignee: Everi Games, Inc., Austin, TX (US)

( * ) Notice: Subject to any disclaimer, the term of this patent is extended or adjusted under 35 U.S.C. 154(b) by 0 days.

(21) Appl. No.: 17/562,524

(22) Filed: Dec. 27, 2021

(65) Prior Publication Data

US 2022/0122410 A1 Apr. 21, 2022

Related U.S. Application Data

(63) Continuation of application No. 17/073,921, filed on Oct. 19, 2020, now Pat. No. 11,210,891, which is a continuation of application No. 16/115,539, filed on Aug. 28, 2018, now Pat. No. 10,810,832.

(60) Provisional application No. 62/567,136, filed on Oct. 2, 2017.

(51) Int. Cl.
*G07F 17/32* (2006.01)

(52) U.S. Cl.
CPC ..... *G07F 17/3216* (2013.01); *G07F 17/3202* (2013.01); *G07F 17/3211* (2013.01)

(58) Field of Classification Search
CPC ..... G07F 17/3216; G07F 17/3202; G07F 17/3211
See application file for complete search history.

(56) References Cited

U.S. PATENT DOCUMENTS

| | | | | |
|---|---|---|---|---|
| 10,502,360 | B2 | 12/2019 | Castro | |
| 2006/0183544 | A1 | 8/2006 | Okada | |
| 2008/0055491 | A1* | 3/2008 | Gordon | G07F 17/3216 463/20 |
| 2008/0113821 | A1 | 5/2008 | Beaded | |
| 2010/0120530 | A1 | 5/2010 | Lesley | |
| 2013/0035159 | A1 | 2/2013 | Cornell | |
| 2016/0184716 | A1 | 6/2016 | Sprenger | |
| 2016/0335836 | A1* | 11/2016 | Castro | G07F 17/3211 |
| 2016/0343204 | A1* | 11/2016 | Maher | E05F 1/1091 |
| 2017/0053482 | A1* | 2/2017 | Ho | G07F 17/3216 |
| 2018/0053373 | A1* | 2/2018 | Goldstein | G07F 17/3213 |
| 2018/0190068 | A1 | 7/2018 | Priddy | |
| 2019/0012874 | A1* | 1/2019 | Goldstein | G07F 17/3218 |

(Continued)

*Primary Examiner* — Jasson H Yoo
(74) *Attorney, Agent, or Firm* — The Culbertson Group, P.C.; Russell D. Culbertson

(57) ABSTRACT

A gaming machine includes a gaming machine cabinet defining an upper cabinet volume and a cabinet front opening to the upper cabinet volume. A gaming machine panel is mounted on the gaming machine cabinet in a panel operating position in which the gaming machine panel registers with and covers a base area of the cabinet front opening. The gaming machine further includes a translation structure connected between the gaming machine panel and the gaming machine cabinet. The translation structure is operable enable the gaming machine panel to be moved from the panel operating position upwardly to a cabinet open position. In this cabinet open position the gaming machine panel remains supported by the gaming machine cabinet and is removed from the base area of the cabinet front opening.

12 Claims, 5 Drawing Sheets

(56) References Cited

U.S. PATENT DOCUMENTS

2019/0080553 A1 11/2019 Hohman
2020/0111300 A1* 4/2020 Priddy ..... G07F 17/3211

* cited by examiner

GAMING MACHINE CABINET ACCESS STRUCTURE AND METHOD

CROSS-REFERENCE TO RELATED APPLICATIONS

This application is a continuation of U.S. patent application Ser. No. 17/073,921 filed Oct. 19, 2020 and entitled "Gaming Machine Cabinet Access Structure and Method," now U.S. Pat. No. 11,210,891, which is a continuation of U.S. patent application Ser. No. 16/115,539 filed Aug. 28, 2018, and entitled "Gaming Machine Cabinet Access Structure and Method," now U.S. Pat. No. 10,810,832, which claims the benefit of U.S. Provisional Patent Application No. 62/567,136 filed Oct. 2, 2017, and entitled "Gaming Machine Cabinet Access Structure and Method." The entire content of each of these applications is incorporated herein by this reference.

TECHNICAL FIELD OF THE INVENTION

The invention relates to gaming machine cabinets, and, more particularly, to arrangements for conveniently opening a gaming machine cabinet to provide access to the interior components. Aspects of the invention include both gaming machine cabinet structures and methods of operation.

BACKGROUND OF THE INVENTION

Gaming machines found in casinos and other gaming establishments commonly include a cabinet on which various display devices and player interface devices are mounted. The display devices may include one or more video display monitors which are operable to display game-related information and other information and to display games conducted at the gaming machine such as video reel-type games, video card games, and other types of wagering games. Player interface devices may include ticket or voucher printers, various control buttons, cash-in or ticket-in devices, and player card readers. Gaming machine cabinets define an interior volume for housing various internal components such as data processing devices and supporting equipment. While the interior components of the gaming machine must remain secured so as to prevent unauthorized access and tampering with the gaming machine, it is still necessary for the gaming machine cabinet to have access points to allow authorized personnel to access the interior volume of the cabinet for maintenance and service purposes.

Providing access to the interior volume of a gaming machine cabinet can be problematic for a number of reasons. One issue arises from the fact that gaming machines are commonly arranged on the casino floor close together side-by-side and either back-to-back with other gaming machines or against a wall. This leaves the front of the gaming machine cabinet as the only exposed portion for providing access to the interior volume when the gaming machine remains in place on the casino floor. Yet in in modern gaming machines, video display monitors and other electronic devices take up a substantial portion of the front surface of the gaming machine, if not the entire front surface, leaving little or no room for access without moving the video display monitors and other electronic equipment from their operating positions on the gaming machine cabinet. Moving the video display monitors from their operating position raises concerns where such devices must remain supported by the gaming machine cabinet because repositioning the devices can leave the gaming machine in danger of tipping over.

SUMMARY OF THE INVENTION

It is an object of the invention to provide gaming machines having a cabinet access structure that provides superior access to the interior volume of the cabinet while the gaming machine remains installed in a bank of gaming machines or other arrangement in a casino or other gaming establishment. Although not limited to such applications, aspects of the present invention are particularly applicable to gaming machines having a single tall display device such as a video display monitor for displaying wagering games and information to players.

In the following disclosure and claims, relative positional terms such as upper, lower, top, bottom, side, above, below, laterally, for example, are used with reference to the orientation of the gaming machine shown in the figures unless specifically stated otherwise.

A gaming machine according to one aspect of the present invention includes a gaming machine cabinet defining an upper cabinet volume above a level of a button deck and defining a cabinet front opening to the upper cabinet volume. A gaming machine panel, which may include a large upright oriented video monitor together with an additional panel component, is mounted on the gaming machine cabinet in a panel operating position in which the gaming machine panel registers with and covers at least a base area of the cabinet front opening. In this operating position an upper edge of the gaming machine panel also registers with and covers an upper extremity of the cabinet front opening. Also, when the gaming machine panel is in its operating position a longitudinal axis of the gaming machine panel extends at a first angle with respect to a slide axis of the gaming machine cabinet and a lower connection of the panel resides at a first level along this slide axis. The gaming machine further includes a translation structure connected between the gaming machine panel and the gaming machine cabinet. The translation structure is operable to enable the gaming machine panel to be moved from the panel operating position upwardly to a cabinet open position. In this cabinet open position the gaming machine panel remains supported by the gaming machine cabinet and the lower connection of the gaming machine panel resides at a second level along the slide axis above the first level so that the gaming machine panel is removed from the base area of the cabinet front opening and so that the upper edge of the gaming machine panel is removed from the upper extremity of the cabinet front opening in this cabinet open position. Also, when the gaming machine panel is in the cabinet open position the longitudinal axis of the gaming machine panel extends at a second angle with respect to the slide axis of the gaming machine larger than the first angle.

The translation structure according to this aspect of the invention has the advantage that the gaming machine cabinet may be opened from the front of the cabinet while the cabinet remains in place on a casino floor and without interfering with player access to adjacent gaming machines. The gaming machine panel, typically including a large video display monitor and other electronic devices, remains neatly supported by the gaming machine cabinet at all times during the course of movement from the operating position to cabinet open position while the gaming machine remains suitably balanced so as to avoid tipping.

In some implementations the translation structure includes a first track mounted on a first side of the gaming machine cabinet within the upper cabinet volume, and a second track mounted on a second side of the gaming machine cabinet within the upper cabinet volume. These two tracks have a common elongated shape, each having a respective upper portion offset forwardly of a respective lower portion in the upper cabinet volume. In this translation structure the gaming machine panel is connected to the track via two connection arms. A first upper connection arm is connected at a distal end thereof to the gaming machine panel at a first side of the panel and is mounted on the first track by a proximal end projection of the first upper connection arm. A second such arm similarly mounts a second side of the panel on the second track. The first and second tracks may each follow a serpentine path with a lowermost length and an upper most length extending substantially vertically.

The translation structure may further include a slide assembly having a first rail mounted substantially vertically on a first side of the gaming machine cabinet within the upper cabinet volume, and a second rail mounted substantially vertically on a second side of the gaming machine cabinet within the upper cabinet volume, and each rail extending parallel to the slide axis. A carriage assembly is mounted on both the first rail and the second rail for longitudinal movement with respect to each rail. In some implementations the carriage assembly may comprise a component that extends the entire distance between the first rail and second rail. In other implementations the carriage assembly may include two separate components, one associated with the first rail and another associated with the second rail. In either carriage assembly arrangement, the lower connection of the gaming machine panel may be mounted on the carriage assembly to facilitate the desired movement of the gaming machine panel.

Another aspect of the invention includes methods for opening a gaming machine cabinet where the gaming machine cabinet defines an upper cabinet volume above a level of a button deck mounted on the gaming machine cabinet and further defines a cabinet front opening to the upper cabinet volume. Methods according to this aspect of the invention include moving a gaming machine panel mounted on the gaming machine upwardly from an operating position for the gaming machine panel to a cabinet open position as described above in connection with the apparatus. In the course of moving the gaming machine panel from the operating position to the cabinet open position, the gaming machine panel remains supported by the gaming machine cabinet but is reoriented so that the longitudinal axis of the gaming machine panel extends at a second angle with respect to the slide axis of the gaming machine larger than the first angle. The reorientation also places the lower connection of the gaming machine panel at a second level along the slide axis of the gaming machine cabinet above the first level so that the gaming machine panel is removed from the base area of the cabinet front opening and so that the upper edge of the gaming machine panel is removed from the upper extremity of the cabinet front opening.

Where the apparatus includes the upper connection arms and first and second tracks as described above in connection with the apparatus, moving the gaming machine panel according to this second aspect of the invention includes sliding the first arm proximal end projection along the first track and sliding the second arm proximal end projection along the second track. Where the apparatus includes the slide assembly described above, moving the gaming machine panel also includes sliding the lower connection of the gaming machine panel along the first rail and second rail.

These and other advantages and features of the invention will be apparent from the following description of illustrative embodiments, considered along with the accompanying drawings.

DESCRIPTION OF REPRESENTATIVE EMBODIMENTS

Figure 1:
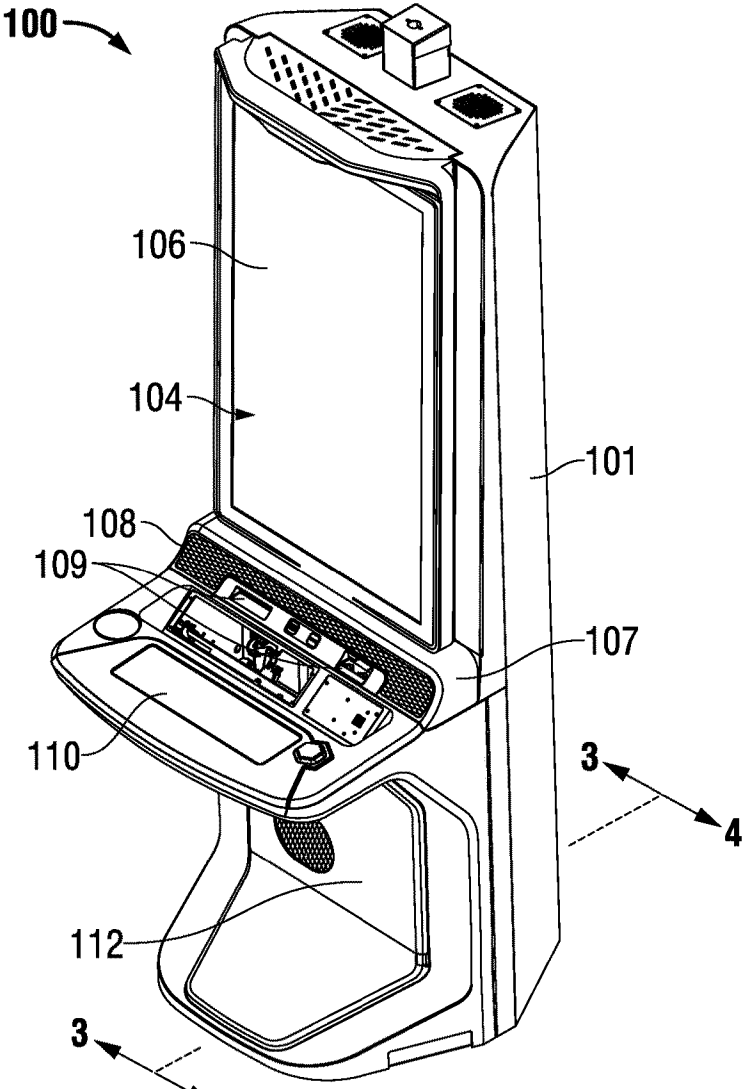
FIG. 1 is a view in perspective of a gaming machine according to aspects of the present invention.

FIG. 1 shows a gaming machine 100 having a cabinet access arrangement in accordance with aspects of the present invention. Gaming machine 100 includes a gaming machine cabinet 101 on which is mounted a panel generally shown at reference numeral 104. Panel 104 in this example includes a tall video display monitor 106 and a gaming machine component housing shown at 107 below the video display monitor. Gaming machine component housing 107 in this example includes a speaker grill 108 and openings 109 for various player interface devices. Gaming machine 100 further includes a button deck 110 protruding from a front side of cabinet 101 and an access door or panel 112 in a lower part of the gaming machine below button deck 110.

Figure 2:
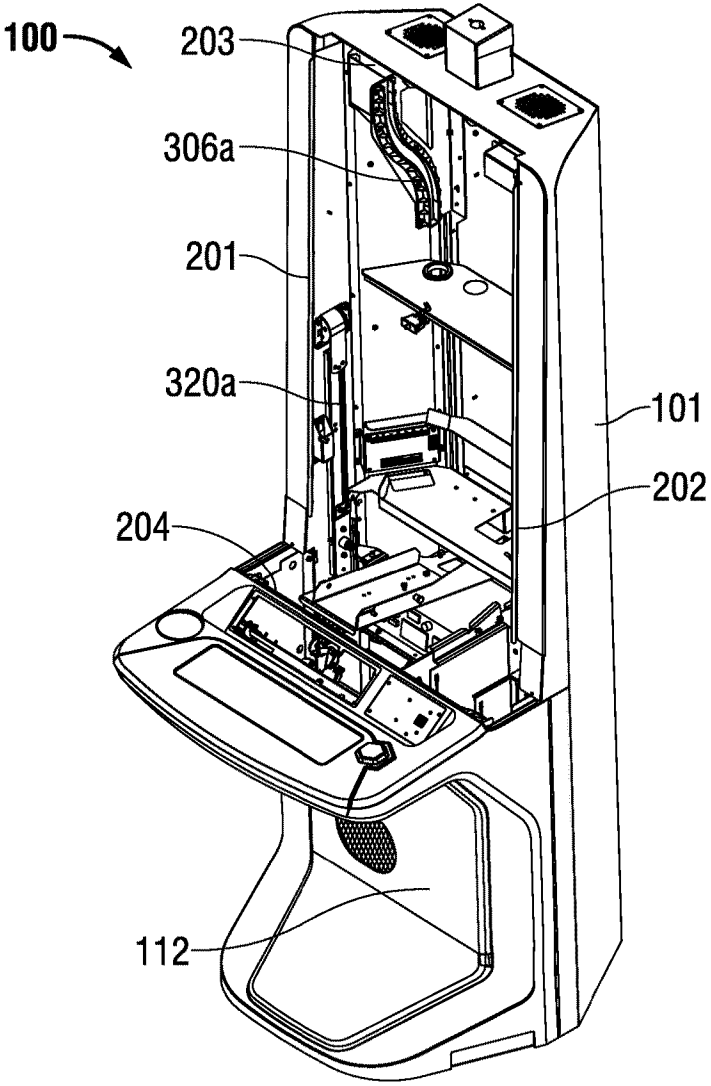
FIG. 2 is a view in perspective of the gaming machine shown in FIG. 1 but with front components removed from the gaming machine cabinet to expose the cabinet upper interior volume and cabinet front opening.

FIG. 2 shows gaming machine 100 with the panel 104 removed to expose an interior volume defined by cabinet 101. FIG. 2 also shows that cabinet 101 defines a front opening to the interior volume. This front opening is bounded on a left side in FIG. 2 at edge 201, on the right side at edge 202, at an upper end at edge 203, and at a lower end at edge 204. In this example gaming machine 100, lower end edge 204 of the cabinet front opening is defined by an upper edge of the structure forming button deck 110. As is apparent by comparing the views of FIGS. 1 and 2, when panel 104 is in an operating position shown in FIG. 1, it registers with and covers the gaming machine cabinet front opening defined by the edges 201, 202, 203, and 204 with a lower extremity of panel 104 abutting edge 204 of the adjacent gaming machine element button deck 110. In particular, panel 104 in the operating position extends laterally across and covers the entire width dimension of the gaming machine cabinet front opening from edge 201 to edge 202. Panel 104 in the operating position also extends vertically across (in the orientation of FIGS. 1 and 2) and covers the entire height dimension of the gaming machine cabinet front opening from edge 204 to edge 203. This height dimension of the gaming machine cabinet front opening encompasses an upper extremity of the cabinet front opening which is bounded on its upper side by upper edge 203.

Figure 3:
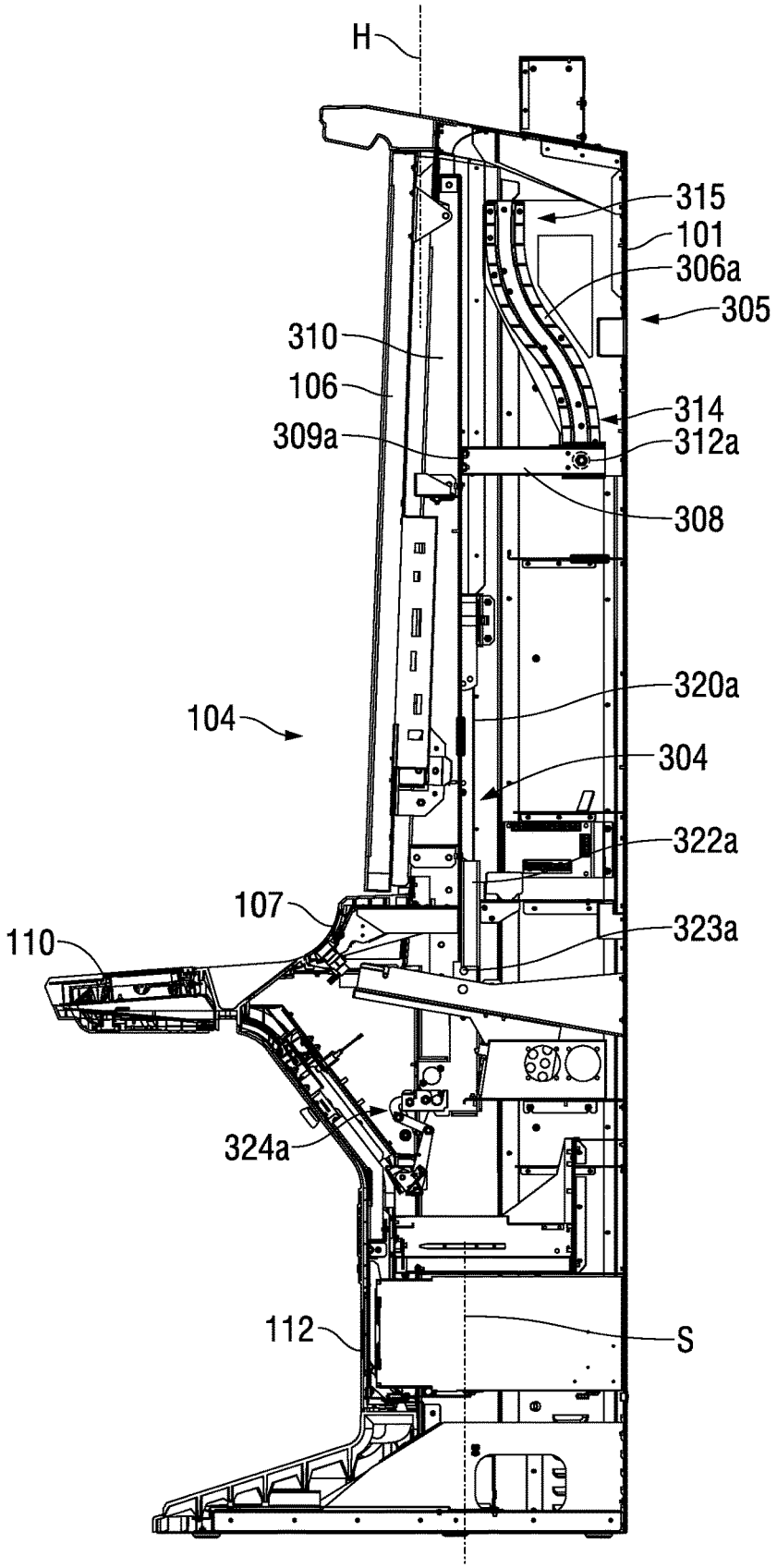
FIG. 3 is a section view in the direction of arrows 3-3 in FIG. 1.

The section view of FIG. 3 also shows the panel 104 made up of video monitor 106 and component housing 107 in its operating position on cabinet 101. In this operating position, panel 104 is oriented with its long side along a longitudinal axis H which is substantially vertical in the example of FIG. 3 ("longitudinal axis" here means the axis parallel to the long edge of the elongated shape of the panel 104). FIG. 3 also shows portions of a translation structure which allows panel 104 to be moved from the operating position shown in FIG. 3 to the cabinet open position illustrated in FIG. 6. The translation structure includes a slide assembly and an upper translation assembly. Portions of the slide assembly are indicated generally by arrow 304, while a portion of the upper translation assembly is indicated generally by arrow 305.

The portion of the upper translation structure visible in the view of FIG. 3 includes a first track 306*a* which is mounted at a first side of cabinet 101 within the interior volume of the cabinet. This first track 306*a* is also visible in the view of FIG. 2. The upper translation structure indicated at arrow 305 also includes a first upper connection arm 308*a*. Upper connection arm 308*a* is connected at a distal end 309*a* to the panel 104 and particularly to a bracket 310 for the panel in this example structure. The proximal end of the first upper connection arm 308*a* includes a projection comprising a roller 312*a*. Roller 312*a* is shown in hidden lines in FIG. 3 (as well as FIGS. 5 and 6) because it resides at the opposite side of first upper connection arm 308*a* to the side visible in the section of FIG. 3 in position where it is mounted on track 306*a*. As will be described further below, roller 312*a* allows the proximal end of upper connection arm 308 to move upwardly following the course of track 306*a*. It should also be noted from FIG. 3 that track 306*a* includes a lower portion indicated generally at 314 which extends substantially vertically in this embodiment and a similar substantially vertical upper portion shown at 315 in FIG. 3.

Figure 4:
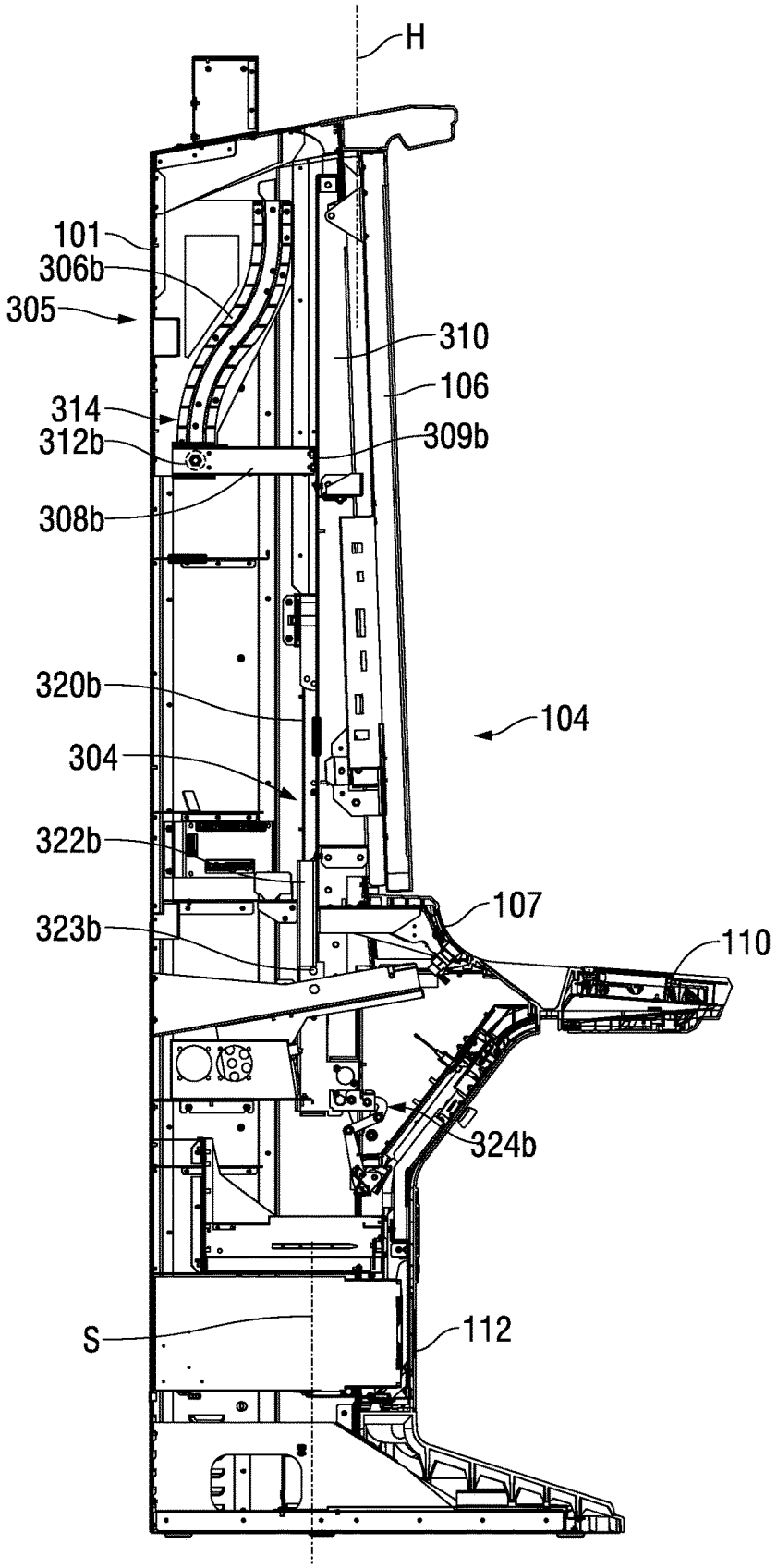
FIG. 4 is a section view in the direction of arrows 4-4 in FIG. 1

It will be appreciated that from the section plane from which the view of FIG. 3 is taken, only the first side of the interior of cabinet 101 is visible. FIG. 4 shows a view in the opposite direction from that shown in FIG. 3 and presents a mirror image of that shown in FIG. 3 as to the translation structure. In particular, the view in FIG. 4 shows a second track 306*b* mounted at an inside of a second side of the gaming machine cabinet 101 within the interior volume. Second track 306*b* in this embodiment includes the same serpentine shape as that of track 306*a*. A second upper connection arm 308*b* is included to connect the panel 104 to cabinet 101. This second upper connection arm 308*b* includes a distal end 309*b* connected to bracket 310 for panel 104 and includes a proximal end with a roller 312*b* similar to roller 312*a* in FIG. 3 and providing the same function as to second track 306*b*.

The portion of slide assembly 304 visible in FIG. 3 includes a first side rail 320*a* and a first carriage 322*a* slideably mounted on first side rail 320*a* so as to facilitate movement of the first carriage along a slide axis S. FIG. 3 also shows a pivot connection 323*a* between a lower portion of panel 104 and carriage 322*a*. A latching mechanism shown generally at 324 is included in a lower portion of cabinet 101 to cooperate with a feature (not shown) at the lower end of first carriage 322*a* to latch the carriage and thus panel 104 in the operating position shown in FIG. 3. Latching mechanism 324 includes a release which is not apparent from the view of FIG. 3 due to the scale of the drawing. This release is preferably accessible through lower door 112.

As with the upper translation structure 305, it will be appreciated that a view in the opposite direction from FIG. 3, the direction shown in FIG. 4, shows essentially a mirror image as to components of the slide assembly 304. Thus FIG. 4 shows a second side rail 320*b* and second carriage 322*b* slidably mounted on that rail for movement along axis S. A pivot connection 323*b* similar to connection 323*a* is also visible in this opposite view from the view of FIG. 3, as is a second latching mechanism 324*b* corresponding to latching mechanism 324*a* for securing that opposite side carriage 322*b* as desired while the panel 104 is in the operating position.

It should be noted that while first carriage 322*a* and second carriage 322*b* may be separate devices, embodiments of the slide assembly may include a connecting structure between first carriage 322*a* and second carriage 322*b*. In this case the pivot connections 323*a* and 323*b* may be to that connecting structure rather than at the carriages. Also, a connecting structure between carriages 322*a* and 322*b* may facilitate a single pivot connection between a lower portion of panel 104 and the connecting structure between carriages 322*a* and 322*b*. A connecting structure between carriages 322*a* and 322*b* may also facilitate a single latching mechanism that cooperates with a feature on the connecting structure to latch the carriages in the operating position as desired.

Figure 5:
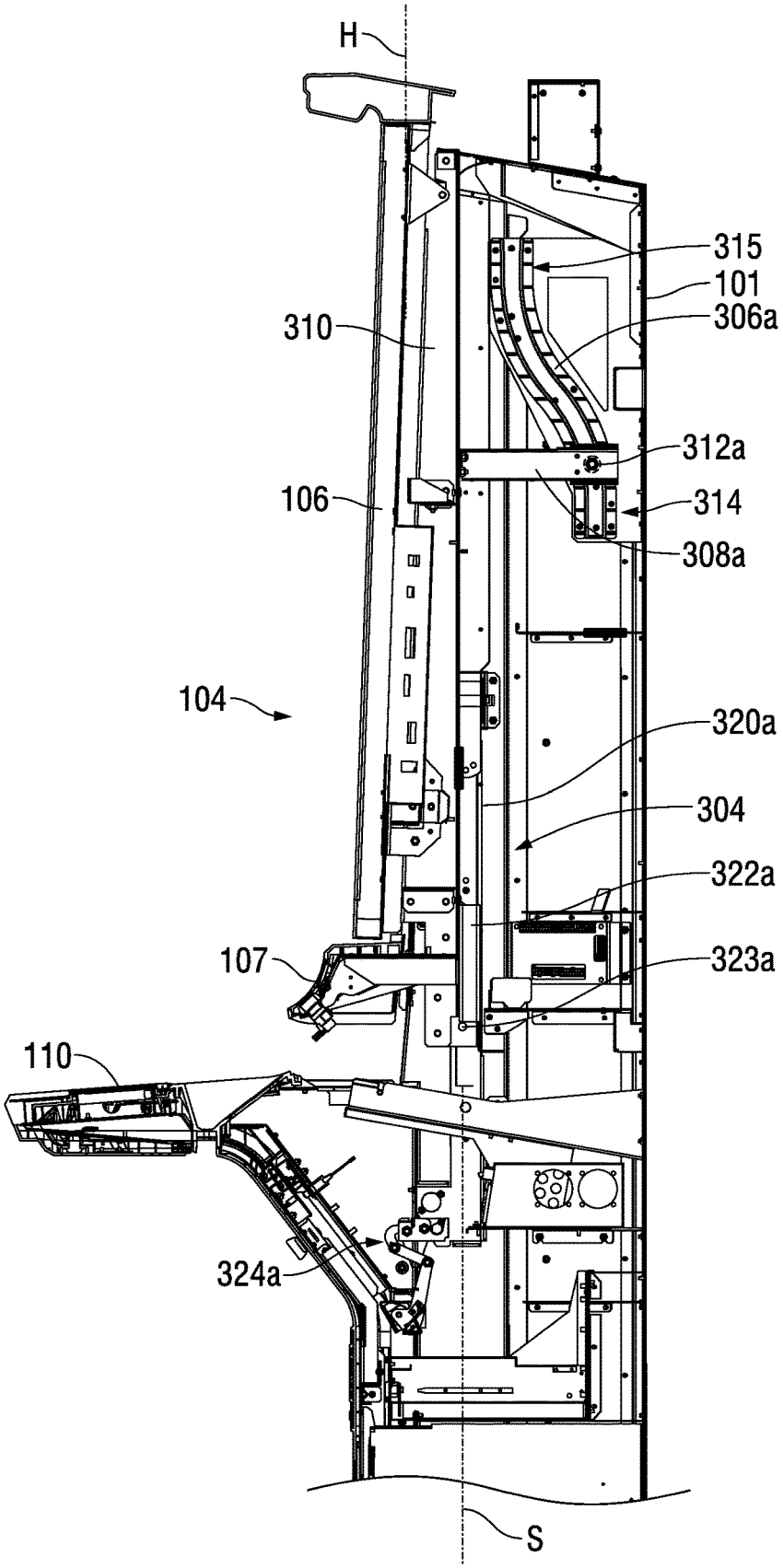
FIG. 5 is an enlarged section view of a central portion of the gaming machine shown in FIG. 1, in the direction of arrows 3-3 in FIG. 1 but showing a front panel of the gaming machine in a position moved upwardly from the operating position shown in FIGS. 1 and 3.

To move panel 104 from its operating position shown in FIGS. 3 and 4, the latching mechanisms 324*a* and 324*b* are operated to release the feature at the lower end of corresponding carriage 322*a* and 322*b*. This allows carriages 322*a* and 322*b* to be moved upwardly along slide axis S. FIG. 5 shows an intermediate position of panel 104 between the operating position shown in FIGS. 3 and 4 and the full open position shown in FIG. 6. The view of FIG. 5 shows that first carriage 322*a* has moved upwardly relative to its position in FIG. 3 as is apparent by the separation of housing 107 portion of panel 104 from button deck 110 and by the separation of the upper edge of panel 104 from its position registering with the upper part of cabinet 101. Also, roller 312*a* is moved upwardly along track 306*a*. However, since roller 312*a* has traversed only a vertical portion 314 of track 306, the longitudinal axis H of panel 104 remains essentially in same position relative to slide axis S as in FIG. 3. Thus in this intermediate position, shown in FIG. 5, gaming machine panel 104 still substantially abuts the lateral edges of the cabinet front opening, namely, edges 201 and 202 shown in FIG. 2. It will be appreciated that in the intermediate position of panel 104 shown in FIG. 5 second carriage 322*b* (shown only in FIG. 4) will also have moved upwardly relative to its position in FIG. 4 and second roller 312*b* will have moved upwardly along second track 306*b* relative to its position in FIG. 4.

Figure 6:
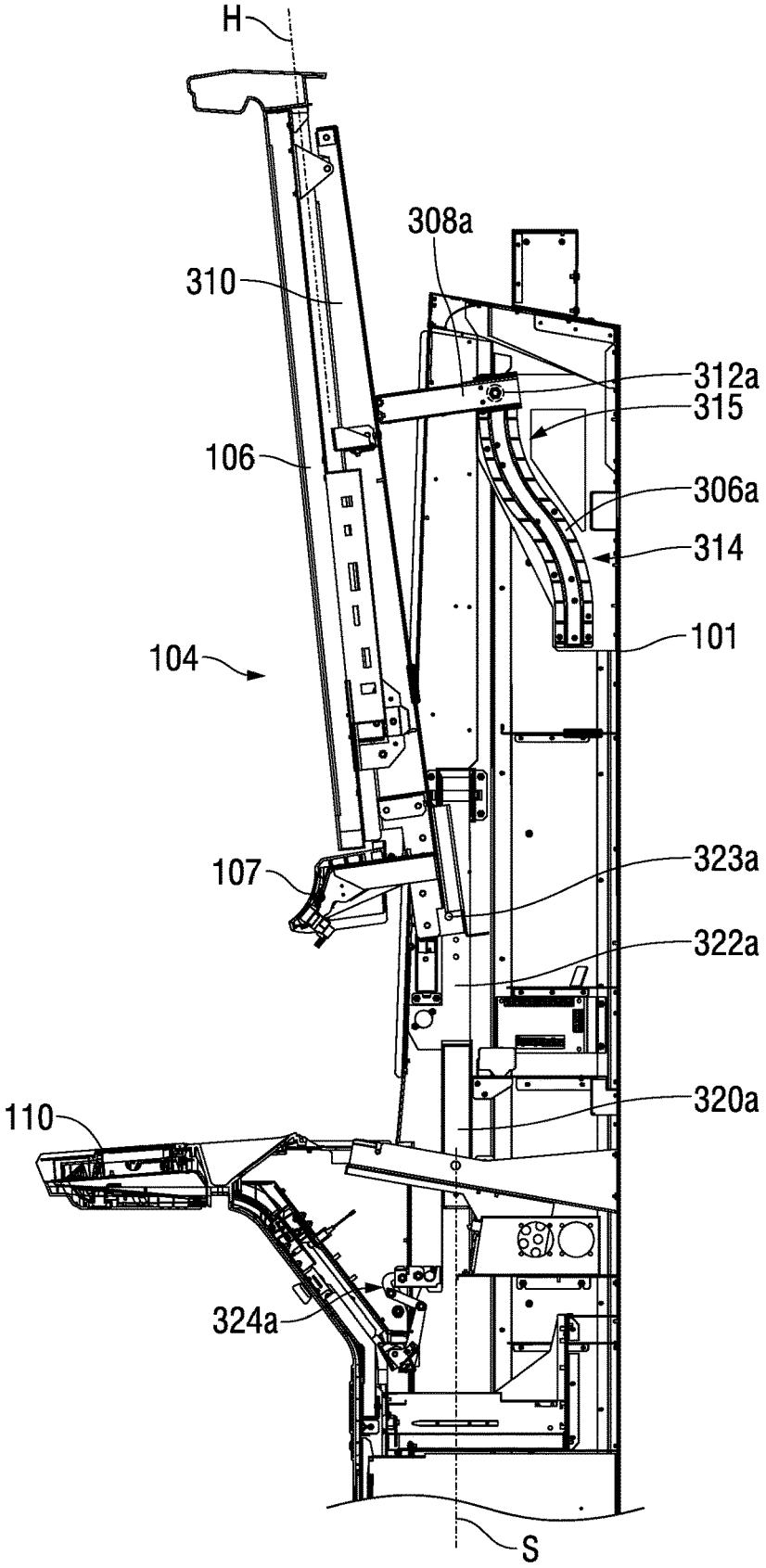
FIG. 6 is a section view similar to FIG. 5 but showing the front panel of the gaming machine in the cabinet open position.

Referring now to FIG. 6, as panel 104 is moved further upwardly on first carriage 322*a*, first roller 312*a* traverses a central serpentine portion of track 306*a* which causes an upper portion of panel 104 to move outwardly away from cabinet 101. A similar movement occurs on the opposite side with second carriage 322*b* and second roller 312*b*. The pivot connection 323*a* between a lower end of panel 104 and carriage 322*a* (and pivot connection 323*b* on the opposite side) allows this forward movement of the upper portion of panel 104 while the lower portion of the panel remains on or near slide axis S. It will be appreciated that in the open position shown in FIG. 6, the interior structure interior volume of cabinet 101 is accessible between the level of the button deck 110 and the lower end of panel 104, generally representing a base area or lower area of the cabinet front opening. Also, the upper portion of panel 104 is separated from cabinet 101, and particularly the upper edge of panel 104 is removed from the upper extremity of the cabinet front opening, to provide access to the interior volume of cabinet in the upper portion thereof. The separation at the top of the cabinet places the longitudinal axis H of panel 104 at an angle to slide axis S which is larger than the angle formed between longitudinal axis H and slide axis S when panel 104 is in its operating position. This angle is determined by the offset in the horizontal direction between the lower and upper ends of tracks 306*a* and 306*b*.

Although not apparent from the view of FIGS. 3-6, biasing devices or dampening devices may be included in the translation arrangement to maintain panel 104 in its full open position. When it is desired to close the cabinet by returning panel 104 to its operating position, a downward force may be applied to the panel against any biasing force associated with the translation apparatus to return the elements to their position shown particularly in FIGS. 3 and 4. Latching mechanisms 324*a* and 324*b* are preferably configured to automatically catch the cooperating feature at the bottom of carriages 322*a* and 322*b* to latch the carriages in place with the panel 104 in the operating position.

The present invention is not limited to any particular structure for rails 320*a* and 320*b*. For example, these rails may have a cylindrical cross-sectional shape as an alternative to the illustrated shape. Similarly, any suitable arrangement may be employed to allow carriage 322*a* and 322*b* to slide along the respective rail along axis S. For example, carriages 322*a* and 322*b* may each include rollers which cooperate with bearing surfaces of the respective rail to facilitate smooth movement of the carriage along the rail while maintaining the orientation of the carriage with respect to the rail. Particularly where the rails have a cylindrical cross-section, carriages 322*a* and 322*b* may include a correspondingly shaped bushing for each rail.

As used herein, whether in the above description or the following claims, the terms "comprising," "including," "carrying," "having," "containing," "involving," and the like are to be understood to be open-ended, that is, to mean including but not limited to. Also, it should be understood that the terms "about," "substantially," and like terms used herein when referring to a dimension or characteristic of a component indicate that the described dimension/characteristic is not a strict boundary or parameter and does not exclude variations therefrom that are functionally similar. At a minimum, such references that include a numerical parameter would include variations that, using mathematical and industrial principles accepted in the art (e.g., rounding, measurement or other systematic errors, manufacturing tolerances, etc.), would not vary the least significant digit.

Any use of ordinal terms such as "first," "second," "third," etc., in the following claims to modify a claim element does not by itself connote any priority, precedence, or order of one claim element over another, or the temporal order in which acts of a method are performed. Rather, unless specifically stated otherwise, such ordinal terms are used merely as labels to distinguish one claim element having a certain name from another element having a same name (but for use of the ordinal term).

The term "each" may be used in the following claims for convenience in describing characteristics or features of multiple elements, and any such use of the term "each" is in the inclusive sense unless specifically stated otherwise. For example, if a claim defines two or more elements as "each" having a characteristic or feature, the use of the term "each" is not intended to exclude from the claim scope a situation having a third one of the elements which does not have the defined characteristic or feature.

The above-described preferred embodiments are intended to illustrate the principles of the invention, but not to limit the scope of the invention. Various other embodiments and modifications to these preferred embodiments may be made by those skilled in the art without departing from the scope of the present invention. For example, in some instances, one or more features disclosed in connection with one embodiment can be used alone or in combination with one or more features of one or more other embodiments. More generally, the various features described herein may be used in any working combination.

The invention claimed is:

1. A gaming machine including:

(a) a gaming machine cabinet defining an upper cabinet volume and defining a cabinet front opening to the upper cabinet volume;

(b) a gaming machine panel mounted on and supported by the gaming machine cabinet in a panel operating position in which (i) the gaming machine panel registers with and covers a lower area of the cabinet front opening so as to extend across the entire width dimension of the lower area of the cabinet front opening, (ii) an upper portion of the gaming machine panel registers with and covers an upper extremity of the cabinet front opening so as to extend across the entire width dimension of the upper extremity of the cabinet front opening, (iii) a longitudinal axis of the gaming machine panel extends at a first angle with respect to a slide axis of the gaming machine cabinet, and (iv) a lower extremity of the gaming machine panel resides at a first level along the slide axis of the gaming machine cabinet substantially abutting an adjacent element of the gaming machine; and (c) a translation structure connected between the gaming machine panel and the gaming machine cabinet, the translation structure operable to enable the gaming machine panel to be moved from the panel operating position upwardly along the slide axis to an intermediate position in which (i) the gaming machine panel remains supported by the gaming machine cabinet, (ii) the upper portion of the gaming machine panel is moved upwardly relative to the upper extremity of the cabinet front opening, and (iii) the lower extremity of the gaming machine panel resides at a second level along the slide axis of the gaming machine cabinet above the first level so that the gaming machine panel is separated from the adjacent element of the gaming machine so as to expose a portion of the lower area of the cabinet front opening, the translation structure also being operable to enable the gaming machine panel to be moved from the intermediate position to a full open position in which (iv) the gaming machine panel remains supported by the gaming machine cabinet and (v) the longitudinal axis of the gaming machine panel extends at a second angle with respect to the slide axis of the gaming machine larger than the first angle.

2. The gaming machine of claim 1 wherein the translation structure includes a slide assembly including:

(a) a first rail mounted on a first side of the gaming machine cabinet within the upper cabinet volume, and a second rail mounted on a second side of the gaming machine cabinet within the upper cabinet volume, the first rail and second rail each extending parallel to the slide axis; and (b) a carriage assembly mounted on both the first rail and the second rail for longitudinal movement with respect to each rail.

3. The gaming machine of claim 2 wherein:

(a) the carriage assembly includes a first side carriage mounted on the first rail for movement along a longitudinal axis of the first rail and a second side carriage mounted on the second rail for movement along a longitudinal axis of the second rail; and (b) the gaming machine panel is mounted on the first side carriage and the second side carriage.

4. The gaming machine of claim 2 wherein when the gaming machine panel is in the intermediate position the gaming machine panel abuts lateral edges of the cabinet front opening along a portion of a length of the gaming machine panel.

5. The gaming machine of claim 4 wherein the gaming machine panel includes a video display monitor of the gaming machine.

6. The gaming machine of claim 1 wherein when the gaming machine panel is moved from the intermediate position to the full open position the upper portion of the gaming machine panel moves forwardly away from the cabinet front opening.

7. A method for opening a gaming machine cabinet which defines an upper cabinet volume and defines a cabinet front opening to the upper cabinet volume, the method including:

(a) moving a gaming machine panel mounted on the gaming machine cabinet upwardly from an operating position for the gaming machine panel in which (i) the gaming machine panel registers with and covers a lower area of the cabinet front opening so as to extend across the entire width dimension of the lower area of the cabinet front opening, (ii) an upper portion of the gaming machine panel registers with and covers an upper extremity of the cabinet front opening so as to extend across the entire width dimension of the upper extremity of the cabinet front opening, (iii) the gaming machine panel is supported by the gaming machine cabinet, (iv) a longitudinal axis of the gaming machine panel extends at a first angle with respect to a slide axis of the gaming machine cabinet, and (v) a lower extremity of the gaming machine panel resides at a first level along the slide axis of the gaming machine cabinet substantially abutting an adjacent element of the gaming machine;

(b) continuing to move the gaming machine panel upwardly from the operating position first to an intermediate position and then to a full open position while the gaming machine panel remains continuously supported by the gaming machine cabinet;

(c) during moving the gaming machine panel from the operating position to the intermediate position, sliding the gaming machine panel upwardly relative to the gaming machine cabinet so that the lower extremity resides at a second level along the slide axis of the gaming machine cabinet above the first level so that the gaming machine panel is separated from the adjacent element of the gaming machine so as to expose a portion of the lower area of the cabinet front opening; and (d) during moving the gaming machine panel from the intermediate position to the full open position, reorienting the gaming machine panel so that the longitudinal axis of the gaming machine panel extends at a second angle with respect to the slide axis of the gaming machine larger than the first angle.

8. The method of claim 7 wherein:

(a) a first rail is mounted on a first side of the gaming machine cabinet within the upper cabinet volume, and a second rail mounted on a second side of the gaming machine cabinet within the upper cabinet volume, the first rail and second rail each extending parallel to the slide axis; and (b) moving the gaming machine panel upwardly from the operating position to the intermediate position includes sliding the gaming machine panel along the first rail and second rail.

9. The method of claim 8 wherein the gaming machine panel is mounted on a carriage assembly and the gaming machine panel slides along the first rail and second rail on the carriage assembly.

10. The method of claim 7 wherein as the gaming machine panel is moved from the operating position to the intermediate position the gaming machine panel abuts lateral edges of the cabinet front opening along a portion of a length of the gaming machine panel.

11. The method of claim 7 wherein the gaming machine panel includes a video display monitor of the gaming machine.

12. The method of claim 7 as the gaming machine panel is moved from the intermediate position to the full open position the upper portion of the gaming machine panel moves forwardly away from the cabinet front opening.

* * * * *